United States Patent [19]

Ishida et al.

[11] 4,047,296

[45] Sept. 13, 1977

[54] TWO-EDGE SHAVING BLADE UNIT HAVING ANTI-CLOGGING MEANS

[75] Inventors: Minoru Ishida, Gifu; Shigeru Ozeki, Seki, both of Japan

[73] Assignee: Feather Safety Razor Company, Ltd., Osaka, Japan

[21] Appl. No.: 709,142

[22] Filed: July 27, 1976

[30] Foreign Application Priority Data

July 31, 1975 Japan ..... 50-10702[U]

[51] Int. Cl.[2] ..... B26B 21/22; B26B 21/40

[52] U.S. Cl. ..... 30/41; 30/50

[58] Field of Search ..... 30/41, 41.5, 41.6, 47, 30/50, 346.58

[56] References Cited

U.S. PATENT DOCUMENTS

| | | | |
|---|---|---|---|
| 2,399,552 | 4/1946 | Larson | 30/41 |
| 3,972,114 | 8/1976 | Chao | 30/41 |

*Primary Examiner*—Jimmy C. Peters

*Attorney, Agent, or Firm*—Pollock, Vande Sande & Priddy

[57] ABSTRACT

A two-edge shaving blade unit having a member for ejecting shaved hair particles and other matter deposited in and clogging a space between the leading and following cutting edges. The upper and lower blade elements are fixed between a platform and a cap portion in a parallel and spaced relation with a spacer interposed therebetween. The ejecting member is retained between the upper and lower blade elements and is loosely fitted around the spacer in a manner displaceable between an advanced and a retracted positions. The cap portion has a resilient rear wall having a knob at its laterally intermediate portion, and to this knob is connected the ejecting member. The ejecting member can be displaced forwardly into the advanced position when the knob is pushed manually so as to eject the hair particles and other matter deposited in and clogging the space between the leading and following cutting edges. Further, when the pushing force on the knob is removed, the knob and thus the ejecting member are displaced to the original retracted position with the resilient force of the resilient rear wall.

3 Claims, 7 Drawing Figures

TWO-EDGE SHAVING BLADE UNIT HAVING ANTI-CLOGGING MEANS

Background of the Invention

The present invention relates to a shaving blade unit for use in safety razors and more particularly to a two-edge shaving blade unit having means for ejecting the shaved hair particles and other matter deposited in and clogging the space between the leading and following cutting edges.

It is known that a two-edge safety razor can provide preferable shaving characteristics. Such razor includes therein two blade elements disposed parallel to each other in spaced relation to provide leading and following cutting edges so that both cutting edges are successively active with respect to the hair elements being cut during a single shaving stroke.

During shaving with the use of the two-edge safety razor, the hair particles and other matter produced are gradually deposited in and thus clog the space between the leading and following cutting edges of the two-edge shaving blade unit. Such deposited matter makes the shaving characteristics of the razor inferior, so that it must be removed at a suitable stage during, before and/or after shaving. Since prior art two-edge shaving blade units do not include therein a means for ejecting the shaved hair particles and other matter deposited, such particles have to be removed by washing, for example. However, this is difficult and time consuming to accomplish.

Summary of the Invention

It is therefore an object of the present invention to provide a two-edge shaving blade unit which overcomes the above disadvantage encountered with the prior art units.

It is another object of the invention to provide a two-edge shaving blade unit having means for easily and preferably removing the shaved hair particles and other matter deposited.

In accordance with the present invention, there is provided a two-edge shaving blade unit comprising a platform portion, a cap portion, two blade elements fixed between the platform and cap portions in a parallel and spaced relation to provide leading and following cutting edges, a spacer fixed between the platform and cap portions for retaining the blade elements in spaced relation, means displaceably disposed in a space between the blade elements for ejecting the shaved hair particles and other matter deposited therein, the ejecting means being ordinarily retained in a retracted position, and means for manually retractably displacing the ejecting means to an advanced or forward position.

Preferably, the spacer is a laterally elongated flat member and is fixed in the space between the blade elements, and the ejecting means is a flat member formed with an opening fitted around the elongated flat member.

Brief Description of the Drawings

The foregoing objects and other objects as well as the characteristic features of the invention will become more apparent and more readily understandable by the following description and the appended claims when read in conjunction with the accompanying drawings, in which:

Detailed Description of the Preferred Embodiment

Figure 1:
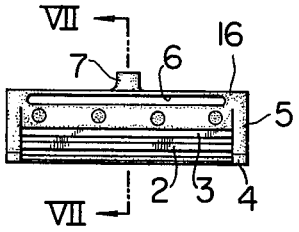
FIG. 1 is a plan view of an embodiment of a two edge shaving blade unit in accordance with the invention.
Figure 7:
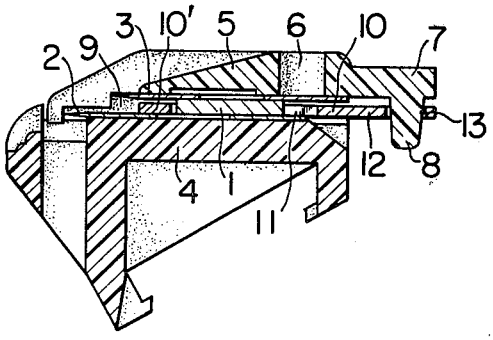
FIG. 7 is a sectional view taken along the line VII—VII in FIG. 1.

Referring first to FIGS. 1 and 7, the two-edge shaving blade unit shown includes a platform portion 4 and a cap portion 5, both may be made of plastic materials. An upper blade element 3 and a lower blade element 2 are fixed between the platform and cap portions 4, 5 in a parallel and spaced relation with a spacer 1 interposed therebetween. The cap portion 5 is formed at its rear portion with a laterally elongated slot 6 for providing a resilient thin rear wall 16. The rear wall 16 has a backwardly projecting knob 7 at its laterally intermediate portion, and the knob 7 has a downwardly projecting pin 8. Pin 8 fits into a hole 13 formed in a backwardly extending projection 12 of a member 10 for ejecting the shaved hair particles and other matter deposited, as will be described in detail hereunder.

Figure 2:
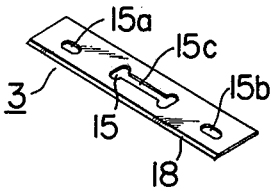
FIG. 2 is a perspective view of an upper blade element of the unit shown in FIG. 1.
Figure 6:
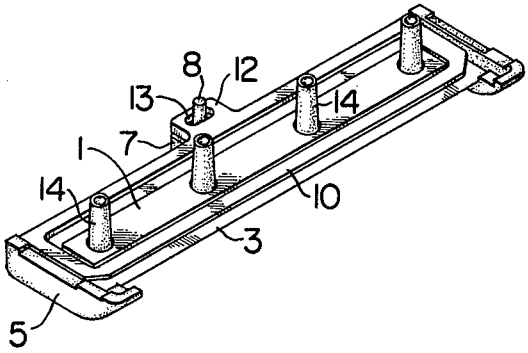
FIG. 6 is a perspective view showing the subassembly of the cap portion, upper blade element, spacer and ejecting member.

As shown in FIG. 6, the cap portion 5 has four projections 14 projecting from its inner wall surface and laterally equidistantly spaced from each other. The projections 14 serve as members for fixing is position the upper and lower blade elements 3, 2 and the spacer 1. FIG. 2 shows the upper blade element 3 formed at its lateral end portions with holes **15*a*, 15*b*, and at its laterally intermediate portion with a slot 15*c* having its lateral ends enlarged. The upper blade element 3 is disposed with its upper surface contacting the inner wall surface of the cap portion 5, and with its cutting edge 18 directed forwardly. Further, the upper blade element 3 is fixed in position with its holes 15*a*, 15*b* and the enlarged lateral ends of the slot 15*c* fitted onto the respective projections 14 as shown in FIG. 6**.

Figure 3:
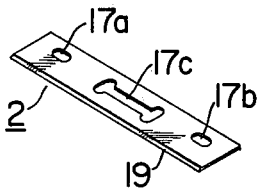
FIG. 3 is a perspective view of a lower blade element of the unit of FIG. 1.

The lower blade element 2 of FIG. 3 is disposed between the platform and cap portions 4, 5 with its lower surface contacting the inner wall surface of the platform portion 4, and with its cutting edge 19 directed forwardly. As will be understood from FIGS. 2 and 3, the lower blade element 2 is substantially identical in structure with the upper blade element 3, except that holes **17*a*, 17*b* and slot 17*c* of the lower blade element 2 is formed at a position slightly rearwardly deviated as compared with the holes 15*a*, 15*b* and the slot 15*c* of the upper blade element 3. Upon assembling, the holes 17*a*, 17*b* and the enlarged lateral ends of the slot 17*c* of the lower blade element 2 are fitted onto the projections 14 of the cap portion 5. Consequently, when the upper and lower blade elements 3, 2 are assembled, the cutting edge 19 of the lower blade element 2 is slightly advanced as compared with the cutting edge 18 of the upper blade element 3**, thus providing the leading and following cutting edges, respectively.

Figure 4:
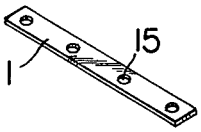
FIG. 4 is a perspective view of a spacer of the unit of FIG. 1.

FIG. 4 shows the spacer 1 consisting of an elongated flat plate or piece formed with equidistantly spaced four holes 15. The spacer 1 is interposed between the upper and lower blade elements 3 and 2 with its holes 15 fitted onto the projections 14. Thus, the upper and lower blade elements 3, 2 are retained in a parallel and spaced relation.

Figure 5:
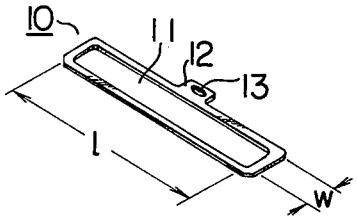
FIG. 5 is a perspective view of a member for ejecting the shaved hair particles and other matter deposited.

The ejecting member 10 shown in FIG. 5 is substantially flat and has an opening 11 adapted to be loosely fitted around the spacer 1. The opening 11 has a lateral length *l* slightly larger than the lateral length of the spacer 1, and a width w fairly larger than a width of the spacer 1. At a laterally intermediate portion of the rear end of the ejecting member 10 is provided the projection 12 formed with the hole 13 which is to be fitted on the pin 8 of the knob 7 of the cap portion 5. Upon assembling, the ejecting member 10 is disposed between the upper and lower blade elements 3, 2 with its opening 11 loosely fitted around the spacer 1. Further, the hole 13 is fitted on the pin 8. Since the knob 7 is provided on the resilient rear wall 16 of the cap portion 5, the knob 7 can be displaced to an advanced or forward position with the flexure of the resilient rear wall 16 when it is pushed manually. Such displacement of the knob 7 causes the displacement of the ejecting member 10, which is fixed at its hole 13 to the pin 8 of the knob 7, since the width w of the opening 11 is fairly large as compared with the width of the spacer 1 as described above. When the pushing force on the knob 7 is removed, the knob 7 and thus the ejecting member 10 are returned to an original retracted position by the resilient force of the rear wall 16. As will be understood, the maximum amount of displacement of the ejecting member 19, i.e., the stroke of the member 10, is determined according to the difference in widths of the opening 11 and the spacer 1.

When the upper and lower blade elements 3, 2, spacer 1 and ejecting member 10 are disposed in position between the platform and cap portions 4, 5, the latter portions are coupled together by suitable means.

Next, the operation of the two edge shaving blade unit of the invention will be described.

As described, the lower blade element 2 and the upper blade element 3 are fixed between the platform and cap portions 4 and 5 in a manner to provide the leading and following cutting edges 19 and 18. These cutting edges 19 and 18 are successively active with respect to the hair elements being cut during a single shaving stroke, so that the safety razor using the unit can provide preferable shaving characteristics. However, the hair particles and other matter produced during shaving will be gradually deposited in and clog a space 9 between the leading and following cutting edges 19 and 18. When this occurs, the user can easily eject the deposited matter by pushing the knob 7. As previously described, when the knob 7 is pushed, the ejecting member 10 is displaced forwardly into the advanced position. Since the forward end portion 10' of the ejecting member 10 is displaced in the space 9, the hair particles and other matter deposited in the space 9 are ejected by this end portion 10'. Further, when the pushing force on the knob 7 is removed, the knob 7 and the ejecting member 10 is returned to the original retracted position. Thus, the user can re-initiate the shaving.

As will be apparent from the foregoing, the shaving blade unit of the invention can easily and preferably remove the hair particles and other matter deposited.

We claim:

1. A two-edge shaving blade unit comprising:

a platform portion, a cap portion, two blade elements fixed between said platform and cap portion, said blade elements being disposed parallel to each other in spaced relation to provide the leading and following cutting edges, spacer means fixed between said platform and cap portions for retaining said blade elements in spaced relation, said spacer means comprising an elongated flat member supported between said blade elements, means disposed between two said blade elements for ejecting the shaved hair particles and other matter deposited therebetween, said ejecting means comprising a flat member formed with an opening loosely fitting around said spacer means and being displaceable between an advanced and a retracted position and ordinarily retained in the retracted position, and means for manually retractably displacing said ejecting means into the advanced position.

2. A two-edge shaving blade unit comprising:

a platform portion, a cap portion, two blade elements fixed between said platform and cap portions, said blade elements being disposed parallel to each other in spaced relation to provide the leading and following cutting edges, spacer means fixed between said platform and cap portions for retaining said blade elements in spaced relation, means disposed between said two blade elements for ejecting the shaved hair particles and other matter deposited therebetween, said ejecting means being displaceable between an advanced and a retracted position and ordinarily retained in the retracted position, and means for manually retractably displacing said ejecting means into the advanced position and comprising a thin resilient wall provided at a rear end portion of said cap portion and a knob projecting from a laterally intermediate portion of said resilient wall, said knob being connected to a projection formed at a rear end of said ejecting means.

3. A two edge shaving blade unit as defined in claim 2, wherein said cap portion is formed of plastic materials, and said resilient wall is provided by forming a laterally elongated slot along the rear end portion of said cap portion.

* * * * *